US008894234B2

(12) United States Patent
Kuo

(10) Patent No.: US 8,894,234 B2
(45) Date of Patent: Nov. 25, 2014

(54) MULTI-COLOR FLASHLIGHT HAVING GUARDING STICK

(75) Inventor: Sheng Kuang Kuo, Zinbei (TW)

(73) Assignee: Fu Daul Chen, Taipei (TW)

( * ) Notice: Subject to any disclaimer, the term of this patent is extended or adjusted under 35 U.S.C. 154(b) by 279 days.

(21) Appl. No.: 13/606,157

(22) Filed: Sep. 7, 2012

(65) Prior Publication Data

US 2013/0250563 A1 Sep. 26, 2013

(30) Foreign Application Priority Data

Mar. 26, 2012 (TW) ..... 101205390 U

(51) Int. Cl.
*F21L 4/02* (2006.01)

(52) U.S. Cl.
USPC ..... 362/205; 362/120; 362/184; 362/231; 362/249.13; 362/253

(58) Field of Classification Search
USPC ..... 362/109, 119, 120, 184, 202, 205, 231, 362/234, 249.02, 249.05, 249.12, 249.13, 362/253
See application file for complete search history.

(56) References Cited

U.S. PATENT DOCUMENTS

| | | | | |
|---|---|---|---|---|
| 1,613,203 | A * | 1/1927 | Shannon | 362/205 |
| 3,737,649 | A * | 6/1973 | Nelson et al. | 362/102 |
| 4,286,311 | A | 8/1981 | Maglica | |
| 4,388,673 | A | 6/1983 | Maglica | |
| 4,398,238 | A | 8/1983 | Nelson | |
| 4,577,263 | A | 3/1986 | Maglica | |
| 4,656,565 | A | 4/1987 | Maglica | |
| 4,658,336 | A | 4/1987 | Maglica | |
| 4,703,402 | A | 10/1987 | Hsieh | |
| 4,733,337 | A | 3/1988 | Bieberstein | |
| 4,819,141 | A | 4/1989 | Maglica et al. | |
| 5,363,285 | A * | 11/1994 | Wideman | 362/102 |
| 5,578,992 | A | 11/1996 | Harding | |
| 6,168,288 | B1 | 1/2001 | St. Claire | |
| 7,651,240 | B2 * | 1/2010 | Bayat et al. | 362/208 |
| 7,686,472 | B1 * | 3/2010 | Huang | 362/208 |
| 2005/0157492 | A1 * | 7/2005 | Chiu | 362/184 |

* cited by examiner

*Primary Examiner* — Ismael Negron

(74) *Attorney, Agent, or Firm* — Charles E. Baxley

(57) ABSTRACT

A flashlight includes a receptacle receiving a processing device and a battery and a light controlling device, the processing device is coupled to the battery and the light controlling device, two light members are coupled to the light controlling device for generating flashlights of different colors, the processing device is coupled to the light members for generating the flashlights, a switch device is coupled to the battery for controlling the processing device to actuate the light members, a control button is coupled to the processing device for operating the light controlling device to operate the light members to generate the flashlights of different colors, and a stick is attachable to the receptacle.

9 Claims, 9 Drawing Sheets

MULTI-COLOR FLASHLIGHT HAVING GUARDING STICK

BACKGROUND OF THE INVENTION

1. Field of the Invention

The present invention relates to a portable flashlight device, and more particularly to a flashlight including a guarding device for generating a flashlight to dazzle the evildoer and for guarding the user himself.

2. Description of the Prior Art

Typical flashlight assemblies comprise a light housing for receiving or engaging with the circuit boards, the batteries, and the light members, and a control or switch member attached or mounted or secured to the light housing for switching or controlling the light members to generate the flashlight and for illuminating purposes or the like.

For example, U.S. Pat. No. 4,286,311 to Maglica, U.S. Pat. No. 4,388,673 to Maglica, U.S. Pat. No. 4,398,238 to Nelson, U.S. Pat. No. 4,577,263 to Maglica, U.S. Pat. No. 4,656,565 to Maglica, U.S. Pat. No. 4,658,336 to Maglica, U.S. Pat. No. 4,703,402 to Hsieh, U.S. Pat. No. 4,733,337 to Bieberstein, U.S. Pat. No. 4,819,141 to Maglica et al, U.S. Pat. No. 5,578,992 to Harding, and U.S. Pat. No. 6,168,288 to St. Claire disclose several of the typical flashlight assemblies or devices each also comprising one or more circuit boards and/or processing devices and/or batteries and/or light members attached or mounted or engaged into the light housing, and a control or switch member for switching or controlling the light members to generate the flashlight selectively.

However, the light members may be used to generate the flashlight only, but may not be used to generate the sparking light to dazzle the evildoer. In addition, the typical light members normally include a weak structure that may not be used to defend or to guard the users themselves.

The present invention has arisen to mitigate and/or obviate the afore-described disadvantages of the conventional flashlight assemblies or devices.

SUMMARY OF THE INVENTION

The primary objective of the present invention is to provide a flashlight including a guarding device for generating a flashlight to dazzle the evildoer and for guarding the user himself.

In accordance with one aspect of the invention, there is provided a flashlight comprising a receptacle including a front portion and a rear portion, and including a chamber formed therein, a processing device disposed in the chamber of the receptacle, a battery disposed in the chamber of the receptacle and electrically connected to the processing device, a light controlling device electrically coupled to the processing device, a first light member and a second light member disposed in the front portion of the receptacle and electrically connected to the light controlling device for selectively generating flashlights of different colors, the processing device being electrically coupled to the first and the second light members for actuating the first and the second light members to selectively generate the bright lights or flashlights, a switch device electrically connected to the battery for controlling the processing device to selectively actuate the first and the second light members to generate the flashlights for illuminating purposes, a control button electrically coupled to the processing device for operating the processing device to actuate the light controlling device to operate the first and the second light members to selectively generate the flashlights of different colors in order to dazzle the evildoer and for guarding the user himself, and a stick may further be provided and attached or coupled to the rear portion of the receptacle for guarding the user from being attacked by an evildoer.

The receptacle includes a hood provided on the front portion of the receptacle for receiving and engaging with the first and the second light members. The receptacle includes a first light casing and a second light casing disposed in the hood for receiving and engaging with the first and the second light members respectively. The first light member is provided for generating a red flashlight, and the second light member is provided for generating a blue flashlight, for example.

The receptacle includes an engaging device provided on the rear portion of the receptacle, and the stick includes an attaching device for engaging with the engaging device of the receptacle and for mounting the stick to the receptacle. The engaging device of the receptacle may be selected from an inner thread or an outer thread, and the attaching device of the stick is selected from an outer thread or an inner thread for threading and engaging with the inner thread of the receptacle.

The stick includes a rough or serrated surface provided thereon for being firmly and solidly and stably and frictionally grasped or held by the user. A carrying belt may further be provided and attached to the stick and the receptacle. The receptacle and the stick each include an ear provided thereon for engaging with the carrying belt.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
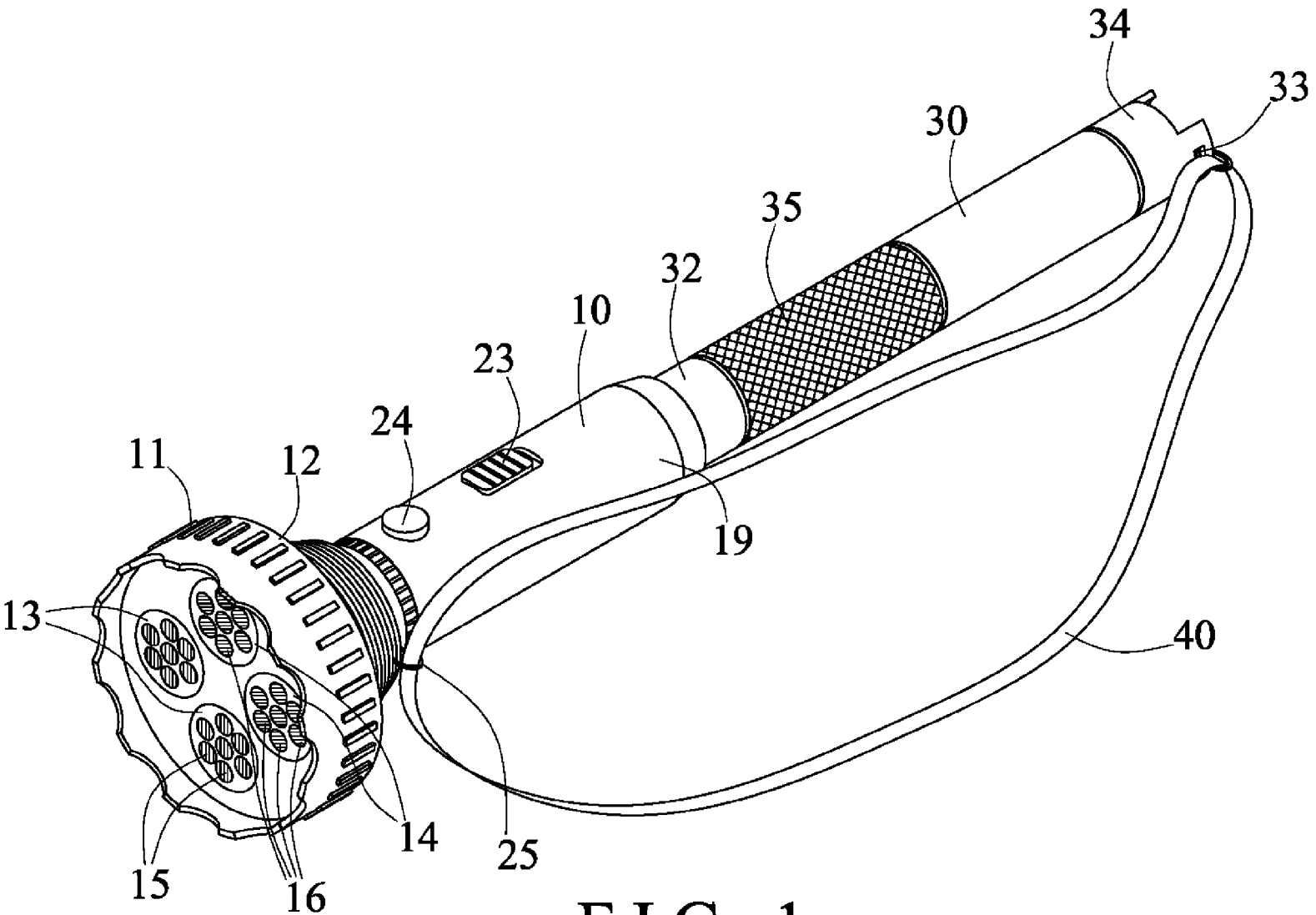
FIG. 1 is a perspective view of a flashlight in accordance with the present invention.
Figure 2:
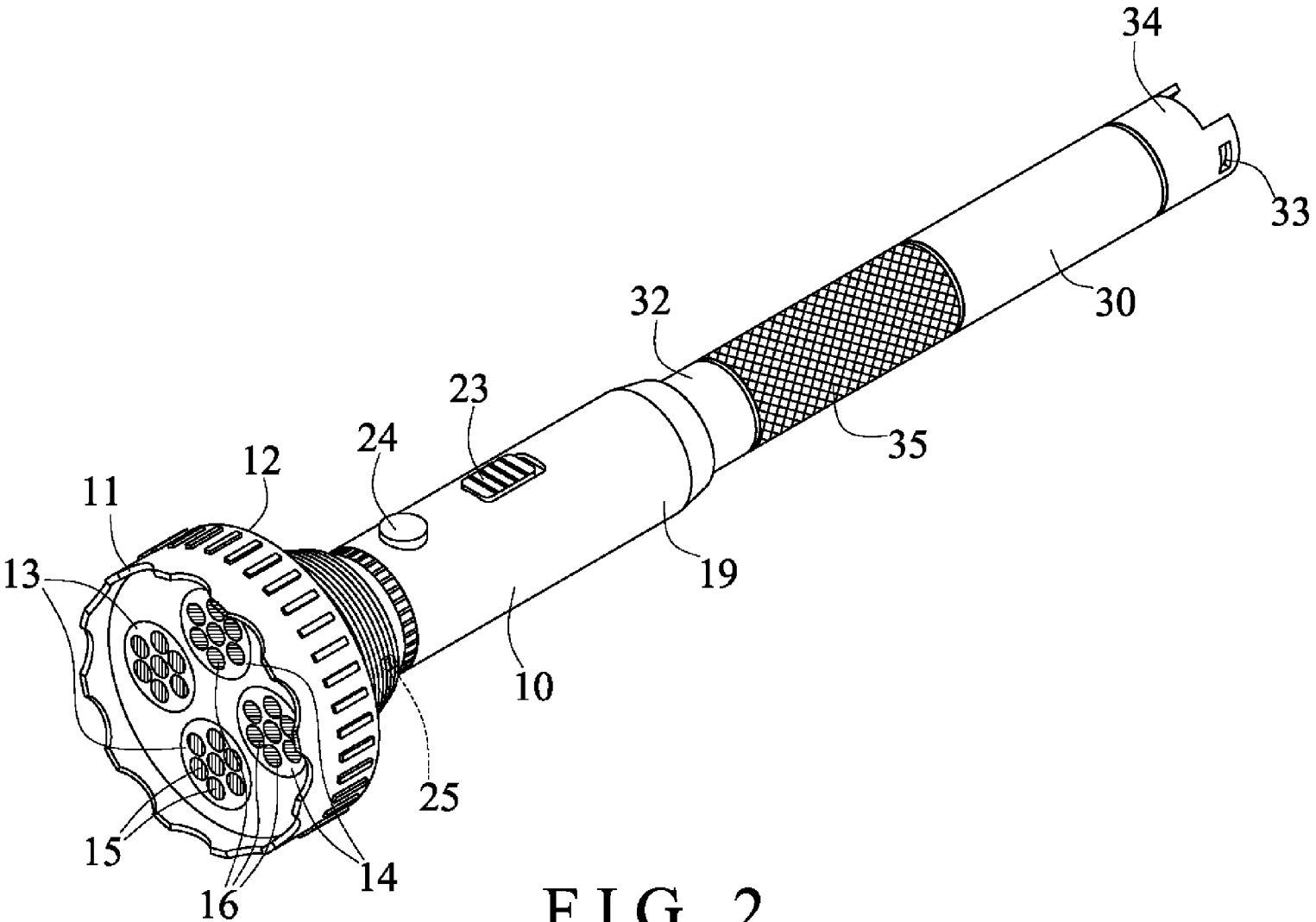
FIG. 2 is a perspective view similar to FIG. 1, in which a carrying belt has been removed from the flashlight.
Figure 3:
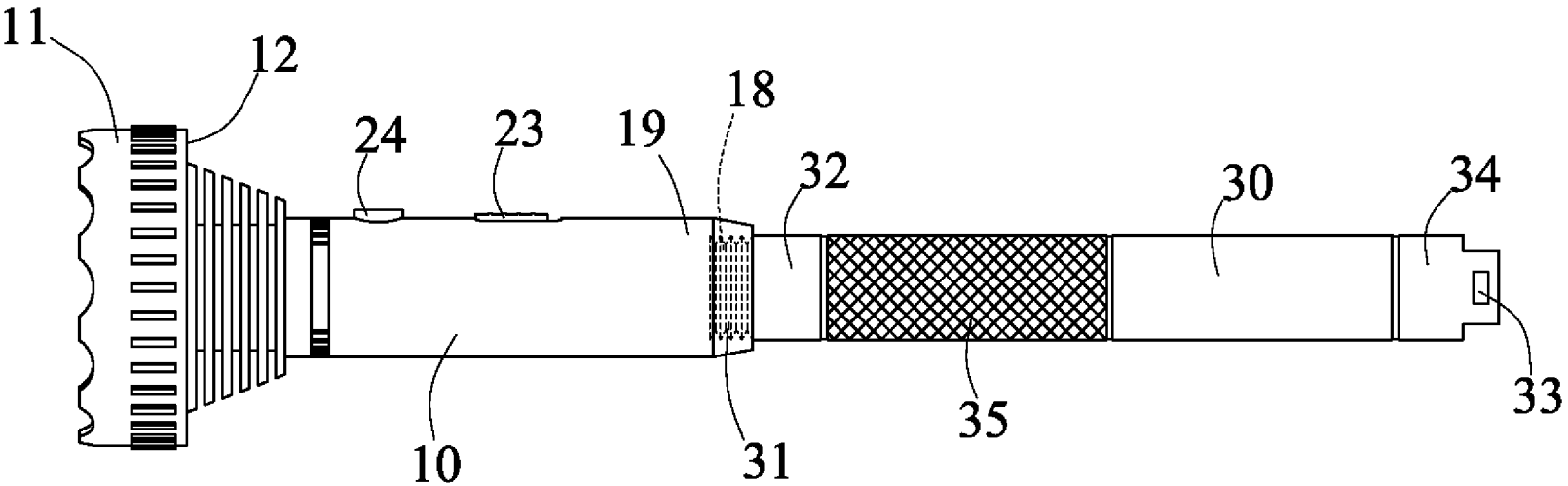
FIG. 3 is a side plan schematic view of the flashlight.

Referring to the drawings, and initially to FIGS. 1-4, a flashlight in accordance with the present invention comprises a light housing or tubular body member or receptacle 10 including a lamp shade or hood 11 attached or mounted or secured to the one or first end or front portion 12 thereof for receiving or supporting or carrying or engaging with one or more light casings 13, 14 therein, and one or more light members 15, 16, such as light bulbs, light emitting diodes (LEDs) 15, 16 received or engaged in the light casings 13, 14 respectively for generating the flashlights. For example, the light members 15 in the light casings 13 may be used to generate the bright and/or red flashlight, and the other light members 16 in the light casings 14 may be used to generate the bright and/or blue flashlight, and the light members 15, 16 may be used to generate the flashlight simultaneously or alternatively.

The receptacle 10 includes a space or chamber 17 formed therein for receiving or engaging with one or more batteries 20, a processing device 21, such as a microcontroller 21 electrically connected or coupled to the batteries 20 which may energize the processing device 21 and the other electrical parts or elements, a light controlling device 22 electrically connected or coupled to the processing device 21 and also electrically connected or coupled to the light members 15, 16 (FIGS. 6, 7), and the processing device 21 may also be directly and electrically connected or coupled to the light members 15, 16. The receptacle 10 further includes a switch member or device 23 electrically connected or coupled to the batteries 20 for switching or controlling or operating the processing device 21 to directly actuate the light members 15, 16 (FIG. 6) to generate the bright light or flashlight and for illuminating purposes or the like.

Figure 7:
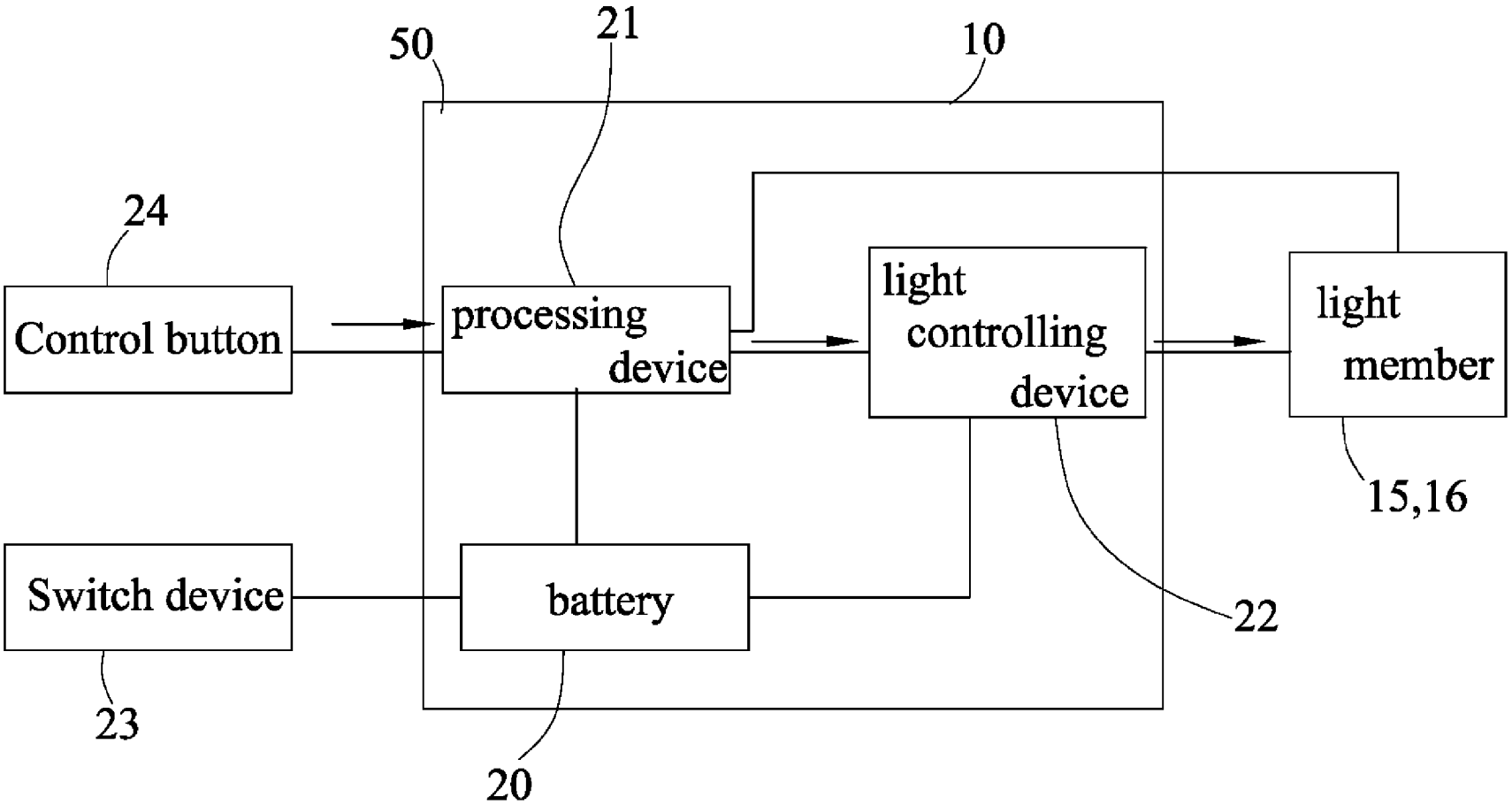
FIG. 7 is another block diagram similar to FIG. 6, illustrating the operation of the flashlight.
Figure 8:
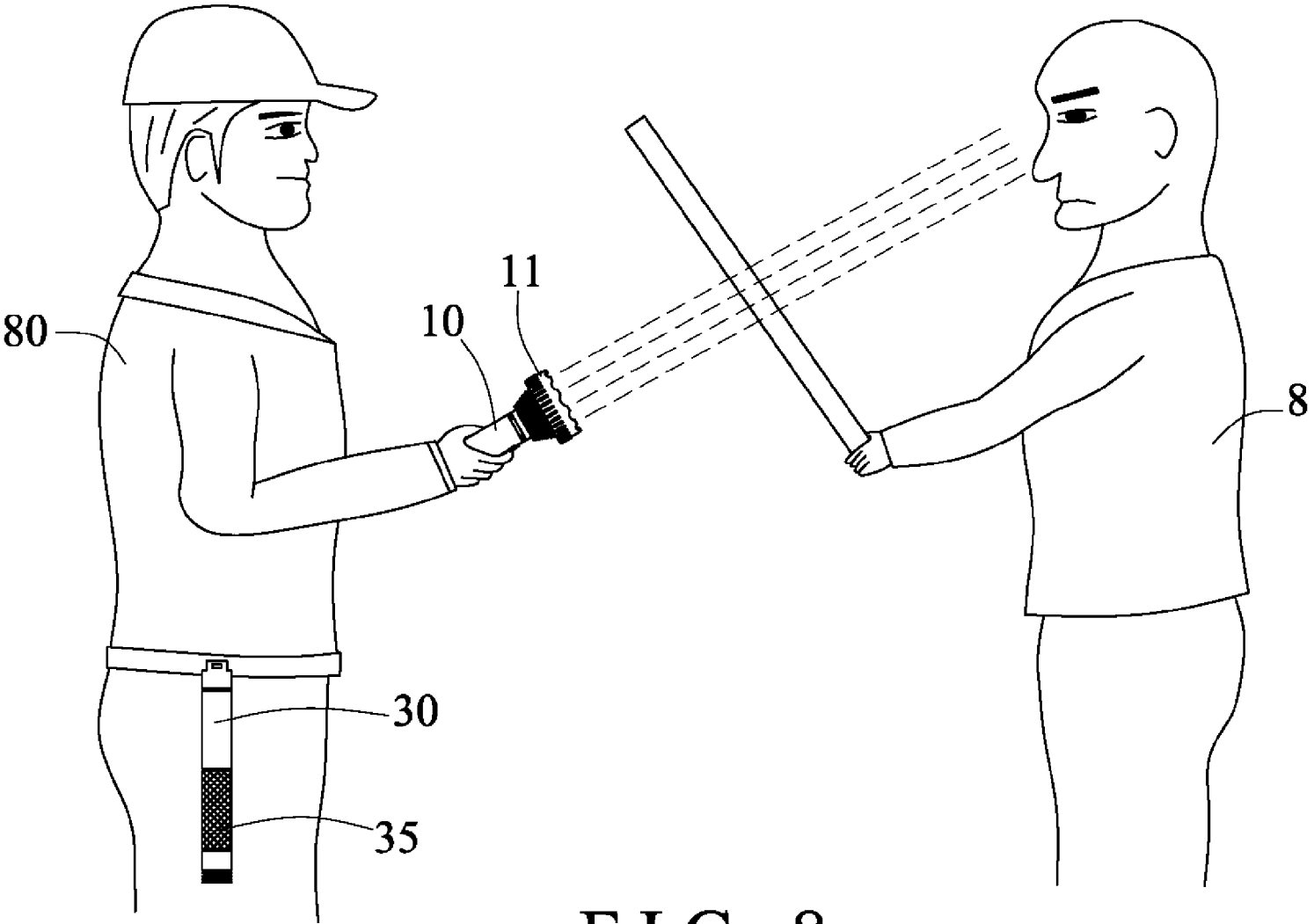
FIGS. 8, 9 are plan schematic views illustrating the operation of the flashlight.

The receptacle 10 further includes another switch member or device or control button 24 electrically connected or coupled to the processing device 21 for switching or controlling or operating the processing device 21 to actuate or operate the light controlling device 22 in order to actuate or operate the light members 15, 16 (FIG. 7) to generate the red flashlight and the blue flashlight; or the blue flashlight and the red flashlight alternatively, so as to dazzle the evildoer 8 and for preventing the evildoer 8 from seeing the user 80 (FIG. 8). It is to be noted that the evildoer 8 may have a visionless problem, persistence of vision or visible persistence problem; i.e., the eyes of the evildoer 8 may be dazzled when seeing the flashlights of different colors alternatively and may not attack the user in a short period of time, and thus for allowing the user to go away from the area that the evildoer 8 may reach.

Figure 9:
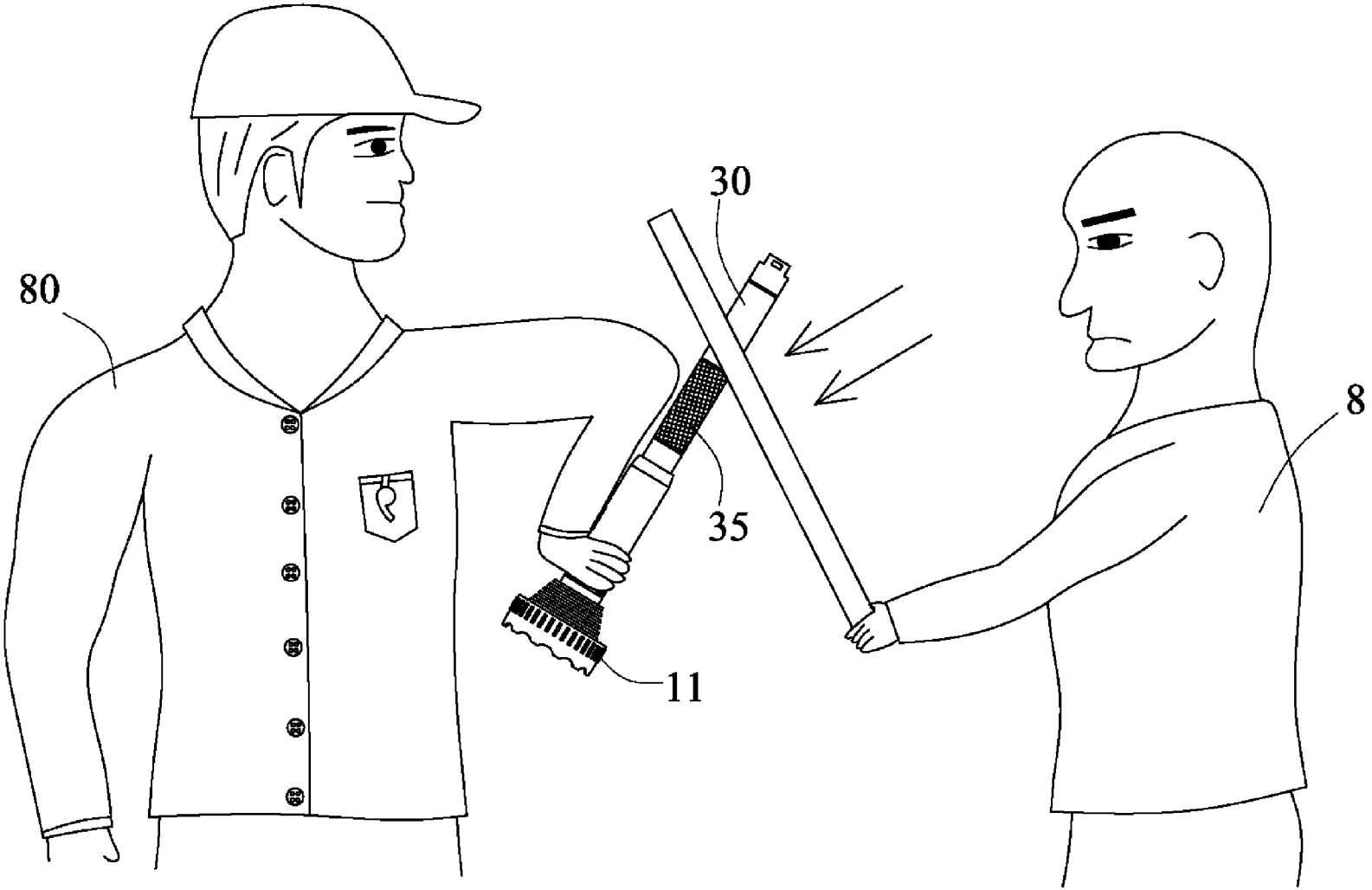

Referring again to FIGS. 1-4, the receptacle 10 further includes an attaching or mounting or securing or engaging member or device 18, such as an inner thread 18 formed or provided on the other or second end or rear portion 19 thereof, and the flashlight in accordance with the present invention further comprises an extension or stem or shank or stick 30 including an attaching or mounting or securing or engaging member or device 31, such as an outer thread 31 formed or provided on the one or first end or front portion 32 thereof for threading or engaging with the inner thread or engaging device 18 of the receptacle 10 and for attaching or mounting or securing or coupling the stick 30 to the receptacle 10 (FIGS. 1-3 and 9) and for allowing the stick 30 to be used as a defending or guarding device for guarding the user 80 himself from being attacked by the evildoer 8 (FIG. 9).

The stick 30 includes a loop or hook or ear 33 formed or provided on the other or second end or rear portion 34 thereof for threading or engaging with a carrying belt 40 (FIG. 1), and the receptacle 10 may further include another loop or hook or ear 25 formed or provided or attached or mounted or secured to the one or first end or front portion 12 thereof for threading or engaging with the carrying belt 40 and for allowing the stick 30 and the receptacle 10 to be easily and quickly and readily attached or mounted or secured to the user 80 with the carrying belt 40. It is preferable that the stick 30 further includes a rough or serrated area or surface 35 formed or provided thereon for being firmly and solidly and stably and frictionally grasped or held by the user 80, and for allowing the stick 30 and the receptacle 10 to be effectively actuated or operated by the user 80.

In operation, the light members 15, 16 may be selectively actuated or operated by the light controlling device 22, with the control button 24 for example, in order to generate the red flashlight and the blue flashlight, or the blue flashlight and the red flashlight alternatively, so as to dazzle the evildoer 8 and for preventing the evildoer 8 from seeing the user 80 (FIG. 8). The light members 15, 16 may also be selectively actuated or operated by the processing device 21 to generate the bright light or flashlight and for illuminating purposes or the like. As shown in FIG. 9, the stick 30 may further be selectively attached or mounted or secured to the receptacle 10 (FIGS. 1-3 and 9) and used as a defending or guarding device for guarding the user 80 himself from being attacked by the evildoer 8.

Figure 4:
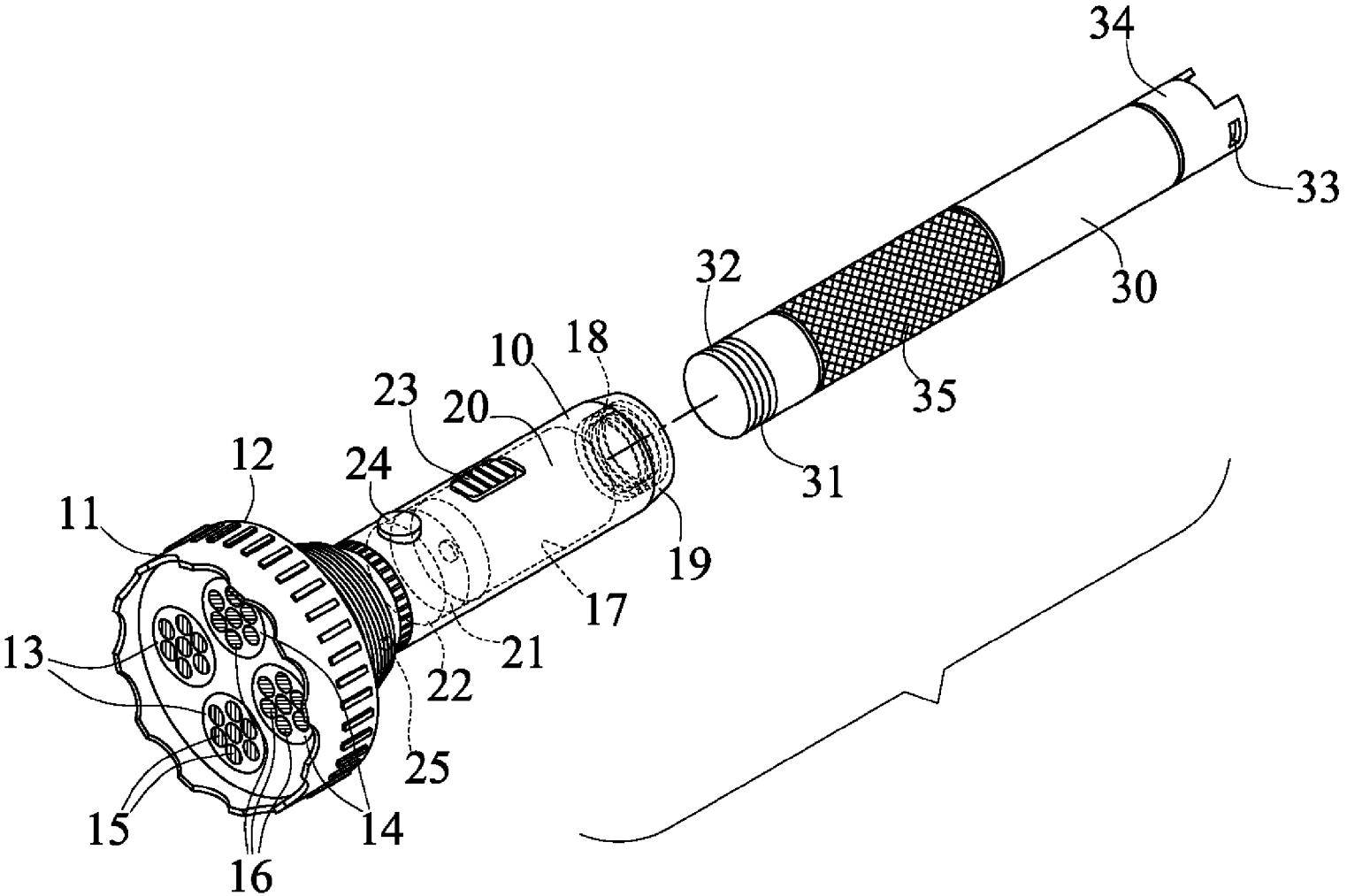
FIG. 4 is a partial exploded view of the flashlight.
Figure 5:
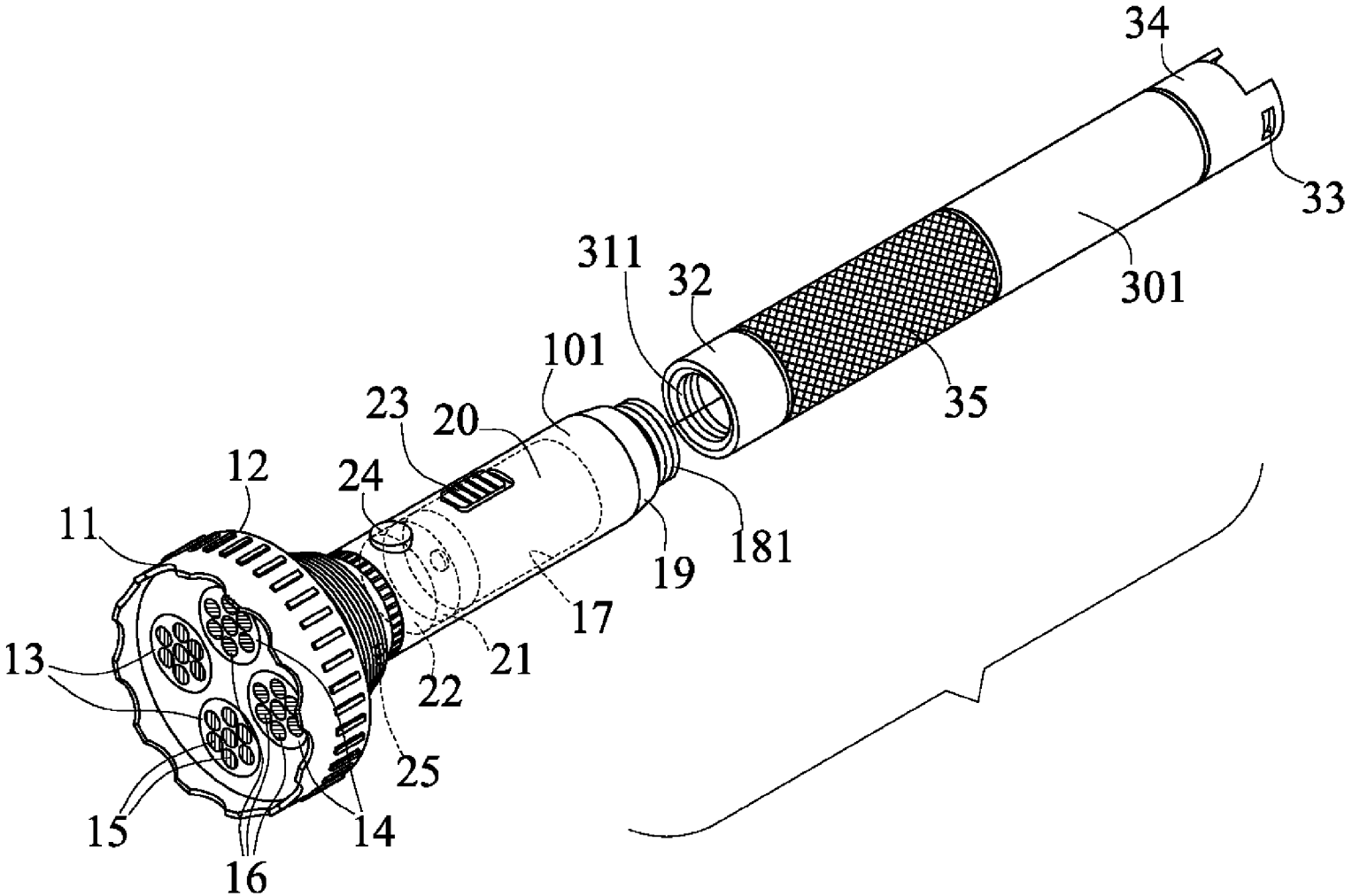
FIG. 5 is another partial exploded view similar to FIG. 4, illustrating the other arrangement of the flashlight.
Figure 6:
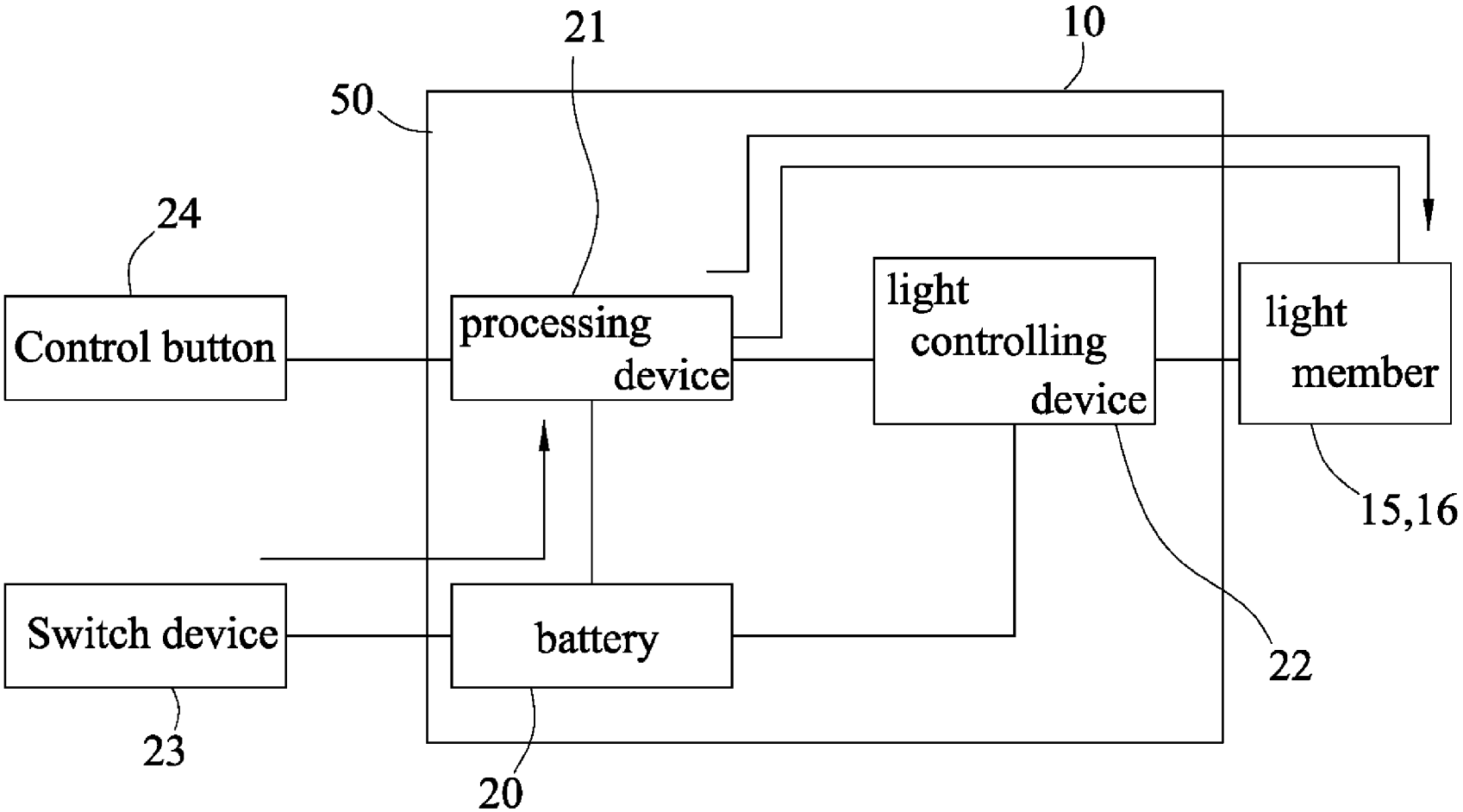
FIG. 6 is a block diagram illustrating the parts or members or elements and the circuit of the flashlight.

It is preferable that the stick 30 and/or the receptacle 10 are made of harder materials, such as harder plastic materials, composite materials, metal materials or the like for allowing the stick 30 and/or the receptacle 10 to resist the attack from the evildoer 8 (FIG. 9). As shown in FIGS. 4 and 5, the batteries 20 and the processing device 21 and the light controlling device 22 may be directly received or engaged in the chamber 17 of the receptacle 10, and/or the receptacle 10 may further include a circuit board 50 for attaching or mounting or securing or carrying or supporting the processing device 21 and the light controlling device 22 and/or the other electrical parts or elements, as shown in FIGS. 6 and 7. Alternatively, as shown in FIG. 5, the receptacle 101 may include an outer thread 181 formed or provided thereon for threading or engaging with the inner thread or engaging device 311 of the stick 301 and for removably attaching or mounting or securing or coupling the stick 301 to the receptacle 101.

Accordingly, the flashlight in accordance with the present invention includes a guarding device for generating a flashlight to dazzle the evildoer and for guarding the user himself, and a stick is attachable to a receptacle for guarding the user from being attacked by an evildoer.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A flashlight comprising:

a receptacle including a front portion and a rear portion, and including a chamber formed therein, a processing device disposed in said chamber of said receptacle, a battery disposed in said chamber of said receptacle and electrically connected to said processing device, a light controlling device electrically coupled to said processing device, a first light member and a second light member disposed in said front portion of said receptacle and electrically connected to said light controlling device for selectively generating flashlights of different colors, said processing device being electrically coupled to said first and said second light members for actuating said first and said second light members to selectively generate said flashlights, a switch device electrically connected to said battery for controlling said processing device to actuate said first and said second light members to generate said flashlights for illuminating purposes, a control button electrically coupled to said processing device for operating said processing device to actuate said light controlling device to operate said first and said second light members to generate said flashlights of different colors, and a stick attached to said rear portion of said receptacle for guarding the user from being attacked by an evildoer.

2. The flashlight as claimed in claim 1, wherein said first light member is provided for generating a red flashlight, and said second light member is provided for generating a blue flashlight.

3. The flashlight as claimed in claim 1, wherein said stick includes a serrated surface provided thereon.

4. The flashlight as claimed in claim 1, wherein said receptacle includes a hood provided on said front portion of said receptacle for receiving and engaging with said first and said second light members.

5. The flashlight as claimed in claim 4, wherein said receptacle includes a first light casing and a second light casing disposed in said hood for receiving and engaging with said first and said second light members respectively.

6. The flashlight as claimed in claim 1, wherein said receptacle includes an engaging device provided on said rear portion of said receptacle, and said stick includes an attaching device for engaging with said engaging device of said receptacle and for mounting said stick to said receptacle.

7. The flashlight as claimed in claim 6, wherein said engaging device of said receptacle is selected from an inner thread, and said attaching device of said stick is selected from an outer thread for threading and engaging with said inner thread of said receptacle.

8. The flashlight as claimed in claim 1 further comprising a carrying belt attached to said stick and said receptacle.

9. The flashlight as claimed in claim 8, wherein said receptacle and said stick each include an ear provided thereon for engaging with said carrying belt.

* * * * *